US009610671B2

(12) United States Patent
Beckman et al.

(10) Patent No.: US 9,610,671 B2
(45) Date of Patent: Apr. 4, 2017

(54) DRAG FINISHING SYSTEM, METHOD AND FIXTURE FOR GAS TURBINE ENGINE AIRFOILS

(71) Applicant: UNITED TECHNOLOGIES CORPORATION, Farmington, CT (US)

(72) Inventors: Micah Beckman, Middletown, CT (US); Thomas James Raymond, Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 553 days.

(21) Appl. No.: 14/132,443

(22) Filed: Dec. 18, 2013

(65) Prior Publication Data

US 2014/0273757 A1 Sep. 18, 2014

Related U.S. Application Data

(60) Provisional application No. 61/777,271, filed on Mar. 12, 2013.

(51) Int. Cl.
*B24B 31/00* (2006.01)
*B24B 31/02* (2006.01)

(52) U.S. Cl.
CPC ..... *B24B 31/003* (2013.01); *B24B 31/0224* (2013.01); *Y10T 29/49998* (2015.01)

(58) Field of Classification Search
CPC ... B24B 31/003; B24B 31/0024; B24B 19/14; B24B 41/06; B23P 15/02
USPC ..... 451/36, 104, 113
See application file for complete search history.

(56) References Cited

U.S. PATENT DOCUMENTS

| | | | | |
|---|---|---|---|---|
| 7,032,904 | B2 | 4/2006 | Rogers | |
| 7,172,199 | B2 | 2/2007 | Rogers | |
| 9,057,272 | B2 * | 6/2015 | Cheah | B24B 31/06 |
| 2003/0027495 | A1 * | 2/2003 | Shaw | B24C 1/04 451/29 |
| 2006/0246825 | A1 * | 11/2006 | Bolz | C23C 4/073 451/36 |
| 2007/0107217 | A1 * | 5/2007 | Baus | B24B 31/064 29/889.1 |
| 2007/0163114 | A1 | 7/2007 | Johnson | |
| 2009/0282677 | A1 * | 11/2009 | Korn | B23P 6/007 29/889.1 |
| 2011/0047777 | A1 * | 3/2011 | Soucy | B24B 31/00 29/525.01 |
| 2013/0323071 | A1 * | 12/2013 | Boon Beng | B24B 31/12 416/234 |

* cited by examiner

*Primary Examiner* — Monica Carter
*Assistant Examiner* — Marcel Dion
(74) *Attorney, Agent, or Firm* — Cantor Colburn LLP

(57) ABSTRACT

A system, fixture and method for media finishing a cluster of airfoils are provided. The fixture may include a base having a first end and a second end, a receptacle disposed on the base and configured to receive the stator cluster, and at least one mock airfoil disposed at each of the first and second ends of the base in alignment with the airfoils of the cluster.

20 Claims, 5 Drawing Sheets

DRAG FINISHING SYSTEM, METHOD AND FIXTURE FOR GAS TURBINE ENGINE AIRFOILS

TECHNICAL FIELD

The present disclosure generally relates to gas turbine engines, and more particularly, to systems and methods for media-finishing airfoils of gas turbine engines.

BACKGROUND

Gas turbine engines are complex pieces of machinery which, generally speaking, have a compressor to compress and direct air to a combustor, where the air is then mixed with a fuel and ignited, and the resulting combustion gases are then passed through a turbine. To capture the moving air and turn same into rotational energy, the compressor and turbine have a plurality of airfoils in the form of radially outwardly extending blades, and radially inwardly extending vanes.

As engine designs have evolved, the materials from which those airfoils are manufactured, as well as their shape and curvature have become increasingly important. Not only must the airfoils be strong, but they must be able to withstand extreme temperature ranges and be as light weight as possible. They must also be aerodynamically smooth. In order to achieve such an aerodynamic surface, airfoils are typically processed through a vibratory media finishing procedure, such as a drag finishing procedure, to polish and remove metals from the surface of the airfoils. In particular, the a cluster of airfoils is often held by spindles or arms of a drag finishing mechanism and driven and/or spun through a bath of abrasive media at a rate sufficient to provide a finished surface thereon.

Current finishing processes, however, often result in inconsistent finishes among the airfoils, where the airfoils located at the outermost ends of the cluster exhibit a significantly higher rate of wear than the inner airfoils. This is due to the substantially free stream of abrasive media passing at the outermost ends of the cluster, in contrast to the more restricted stream of media passing through the inner airfoils of the cluster.

Such inconsistencies not only cause significant losses in engine efficiency and performance, but also weaken the integrity of the outermost airfoils making them more prone to damage over time. Accordingly, there is a need to provide improved and more consistent apparatus and method for media finishing sensitive metals, such as airfoils. The present disclosure aims to overcome one or more of the deficiencies set forth above.

SUMMARY OF THE DISCLOSURE

In one aspect of the present disclosure, fixture for coupling a stator cluster having a plurality of airfoils to a media finishing mechanism is provided. The fixture may include a base having a first end and a second end, a receptacle disposed on the base and configured to receive the stator cluster, and at least one mock airfoil disposed at each of the first and second ends of the base in alignment with the airfoils of the stator cluster.

In a refinement, the receptacle may include a radial curvature corresponding to a radial curvature of the stator cluster, and each of the mock airfoils may include an axial curvature corresponding to an axial curvature of each of the airfoils of the stator cluster.

In another refinement, each mock airfoil may be sized and configured corresponding to a size and configuration of each airfoil of the stator cluster. The mock airfoils may be configured to reduce a wear rate of the endmost airfoils.

In another refinement, the base may include more than one mock airfoil on each end thereof. Each mock airfoil may have a thickness which approximates a thickness of each airfoil.

In another refinement, the base may include one mock airfoil on each end thereof. Each mock airfoil may have a thickness that is greater than a thickness of each airfoil.

In yet another refinement, the base may be attachable to a drag finishing mechanism.

In another aspect of the disclosure, a system for media finishing is provided. The system may include at least one stator cluster having a plurality of airfoils radially disposed thereon, a fixture having a first end, a second end, and a receptacle disposed between the first and second ends configured to receive the stator cluster, at least one mock airfoil disposed at each of the first and second ends of the fixture in radial alignment with and adjacent to the endmost airfoils of the stator cluster; and an abrasive media bath into which the fixture and airfoil cluster are placed and dragged In a refinement, the airfoils may be radially inwardly disposed on the stator cluster and separated by a predefined distance. Each mock airfoil may be radially inwardly disposed on the fixture and separated from the adjacent endmost airfoil by the predefined distance.

In another refinement, the receptacle may include a radial curvature which corresponds to a radial curvature of the stator cluster, and each of the mock airfoils may include an axial curvature corresponding to an axial curvature of each of the airfoils of the stator cluster.

In another refinement, each mock airfoil may be sized and configured corresponding to a size and configuration of each airfoil of the stator cluster. The mock airfoils may be configured to reduce a wear rate of the endmost airfoils.

In another refinement, a thickness of each mock airfoil may be greater than a thickness of the airfoils.

In another refinement, more than one mock airfoil may be disposed at each end of the fixture.

In a related refinement, a thickness of each mock airfoil may be substantially equal to a thickness of the airfoils.

In yet another refinement, the airfoil cluster is one of a stator vane cluster and a rotor blade cluster.

In yet another aspect of the disclosure, a method for media finishing a stator cluster having a plurality of airfoils is provided. The method may determine a configuration of the airfoils, provide a fixture having at least one mock airfoil of substantially like configuration at each end thereof, attach the stator cluster onto the fixture such that each mock airfoil is positioned adjacent to and in alignment with an endmost airfoil of the stator cluster, and couple the fixture to a media finishing mechanism.

In a refinement, each mock airfoil may be sized and configured corresponding to a size and configuration of each airfoil of the stator cluster. The mock airfoils may be configured to reduce a wear rate of the endmost airfoils.

In another refinement, the fixture may further be provided with a receptacle for receiving the stator cluster thereon. The receptacle may be provided with a radial curvature corresponding to a radial curvature of the stator cluster.

In another refinement, more than one mock airfoil may be provided on each end of the fixture. Each mock airfoil may have substantially the same thickness as each airfoil of the stator cluster.

In another refinement, each mock airfoil may be configured such that an axial curvature thereof substantially corresponds to an axial curvature of the stator cluster airfoils.

In yet another refinement, the fixture may be coupled to a drag finishing mechanism.

These and other aspects and features of the present disclosure will be more readily understood when read in light of the accompanying drawings.

DETAILED DESCRIPTION

Figure 1:
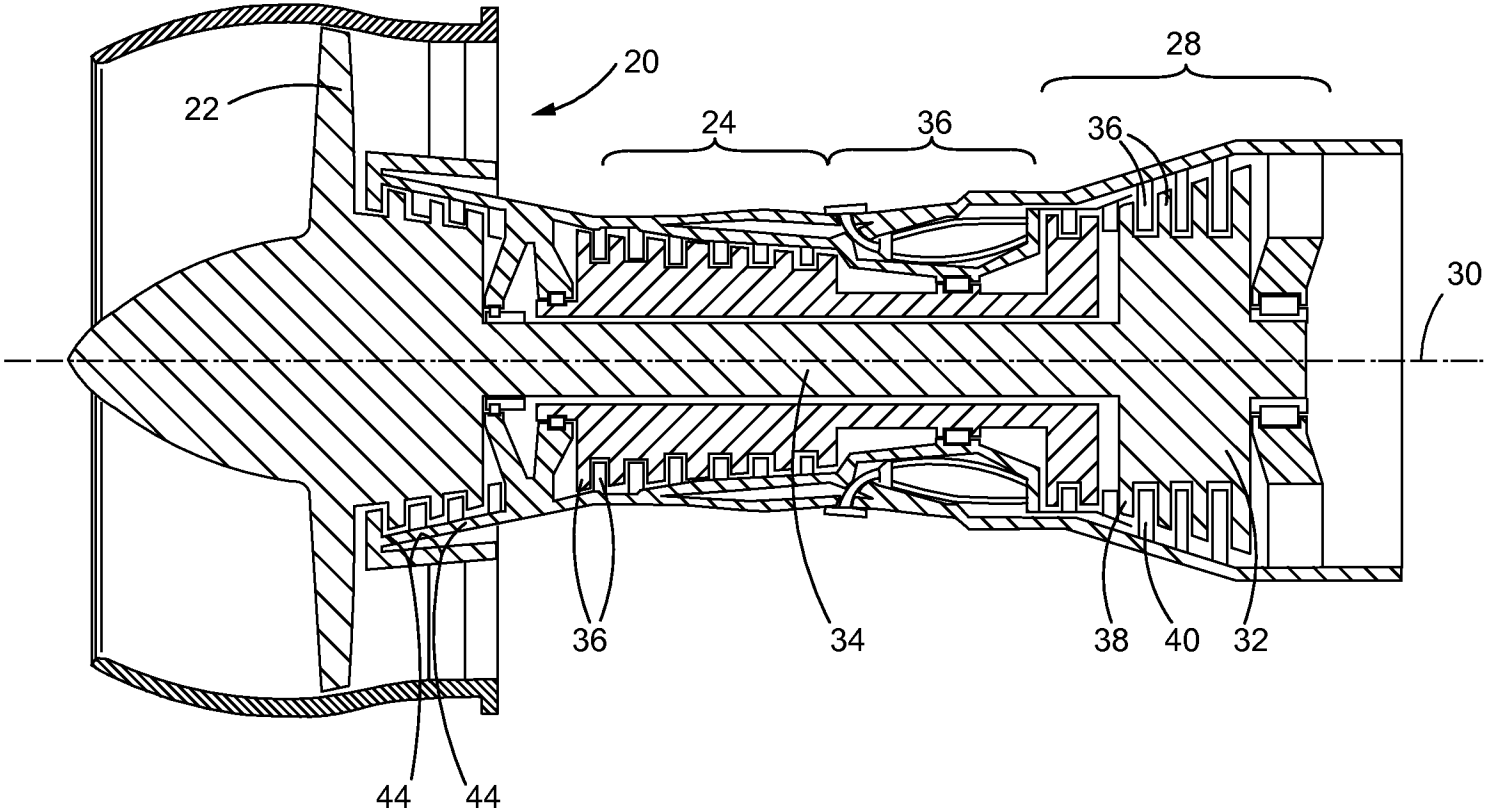
FIG. 1 is a sectional view of a gas turbine engine using airfoils constructed in accordance with the teachings of this disclosure.

Referring now to FIG. 1, a gas turbine engine constructed in accordance with the teachings of this disclosure is generally referred to be reference numeral 20. As gas turbine engines are widely known, the exact details of their inner workings will not be recited herein, only those details necessary for the understanding of the present disclosure.

As shown, the gas turbine engine 20 includes a fan 22, compressor 24, combustor 26, and turbine 28 axially aligned along axis 30. As the fan 22 rotates, ambient air is directed into the compressor 24. That air is compressed by the compressor 24 and in turn directed to the combustor 26 where it is mixed with fuel and ignited. The resulting combustion gases are then passed through the turbine 28 causing the rotor 32 of the turbine 28 to rotate. As the rotor 32 is mounted to a shaft 34 extending along the axis 30, rotation of the turbine 28 also causes the compressor 24 to rotate to thus continue the cycle. Many different gas turbine engine designs exist, including dual spool engines with high and low pressure compressors and turbines mounted on concentric shafts, but again such details are widely known in the industry and need not be repeated herein.

In order to capitalize on the movement of the air through the engine, and both align that moving air as desired and transform it into rotational energy in the shaft 34, the compressor 24 and turbine 28 include a plurality of specifically shaped airfoils 36. More specifically, the compressor 24 and turbine 28 include airfoils 36, which may be provided in the form of radially outwardly extending rotor blades 38, and radially inwardly extending stator vanes 40. The blades 38 are curved and movable so as to capture the moving air and cause the compressor 24 and/or turbine 28 to rotate, while the vanes 40 are fixed so as to reorient and align the incoming moving air as desired before being communicated to the next blade.

Figure 2:
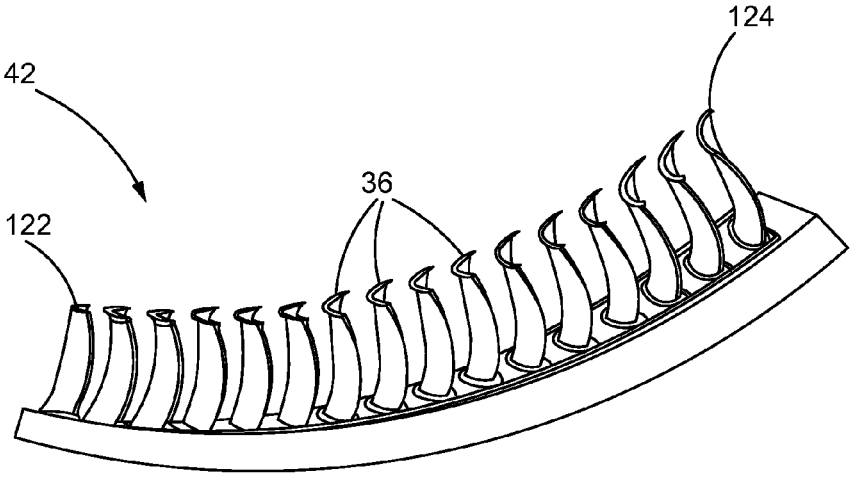
FIG. 2 is a perspective view of an exemplary airfoil cluster constructed in accordance with the teachings of this disclosure.

During the assembly of such compressors 24 and turbines 28, groups of airfoils 36 are joined together in clusters 42, one of which is shown in FIG. 2. A number of clusters 42 are then arrayed end to end to form a complete ring around the engine 20. Such a ring is referred to as a stage 44 as shown in FIG. 1. Accordingly, the blades 38 of one stage 44 capture incoming moving air and direct same through the vanes 40 of that same stage so as to align the moving air toward the next stage 44. Modern gas turbine engines have compressors 24 and turbines 28 with multiple stages, often in excess of ten of more.

Referring again to FIG. 2, it will be noted that each airfoil 36 is provided with a very particular shape and curvature. This is to enable the airfoil 36 to most effectively capture the moving air and compress, accelerate or align same as needed. In order to do so, the airfoil is provided with an aerodynamically smooth exterior surface 46. However, as the airfoils are made for particular materials so as to provide the necessary strength, weight and temperature resistance needed, the provision of that aerodynamically smooth surface 46 is challenging. It is here that the present disclosure drastically departs from, and improves upon, the prior art.

Figure 4:
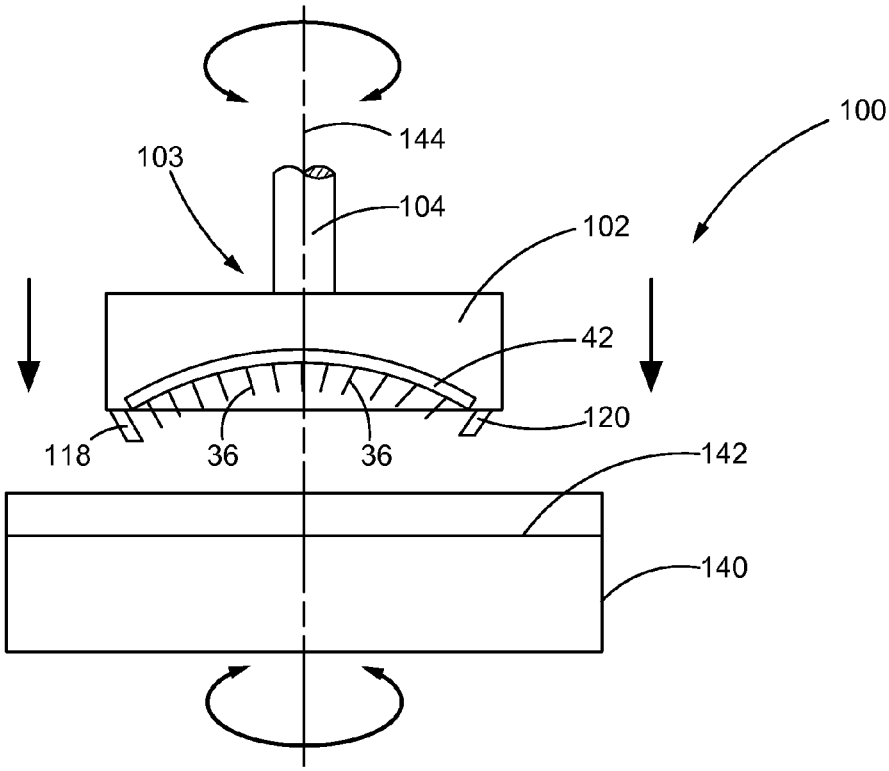
FIG. 4 is a schematic illustration of a media finishing system according to one embodiment of the present disclosure showing the fixture and airfoil cluster of FIG. 3 and abrasive material bath.
Figure 3:
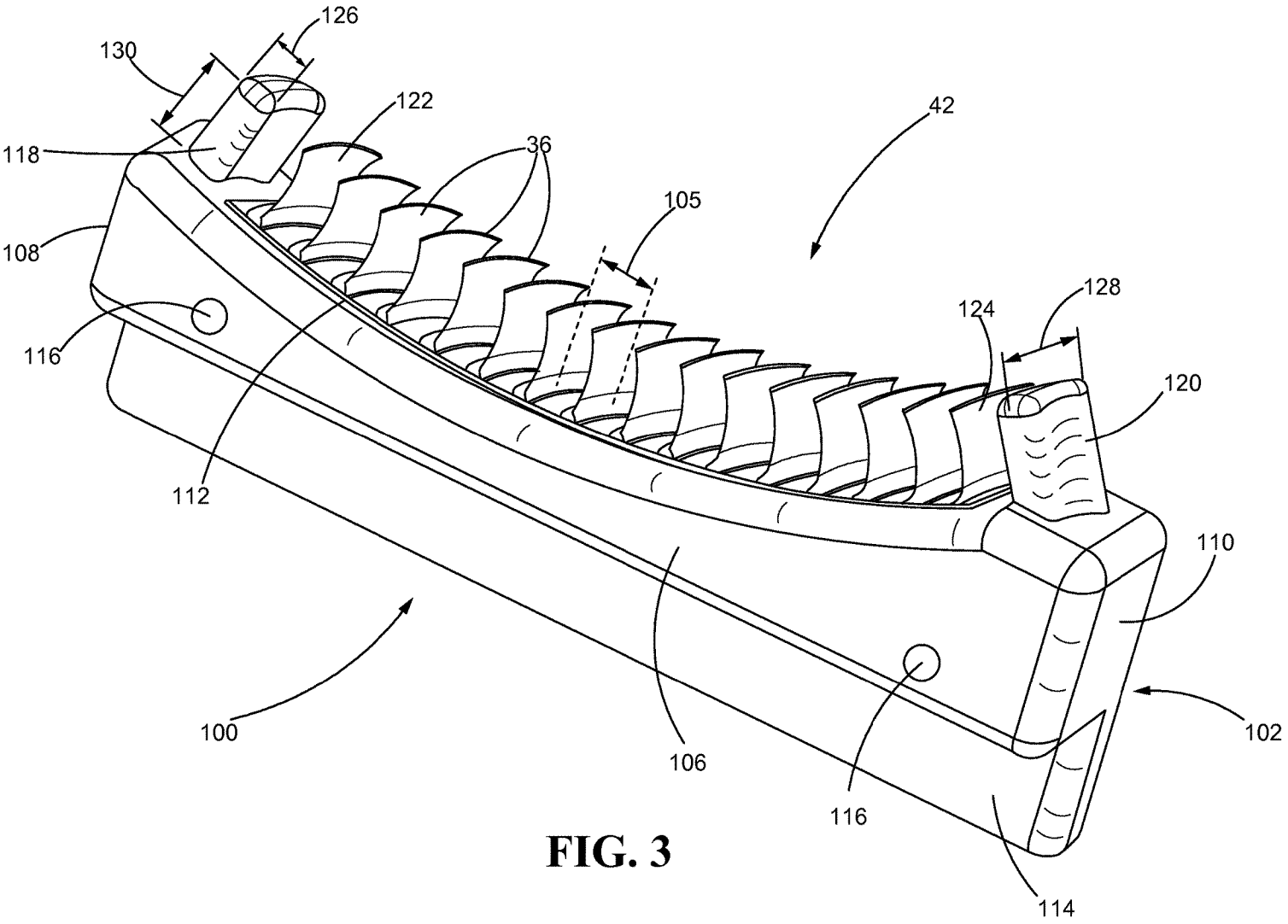
FIG. 3 is a perspective view of one exemplary fixture with mock airfoils constructed in accordance with the teachings of the present disclosure, with the airfoil cluster of FIG. 2 mounted therein.
Figure 3A:
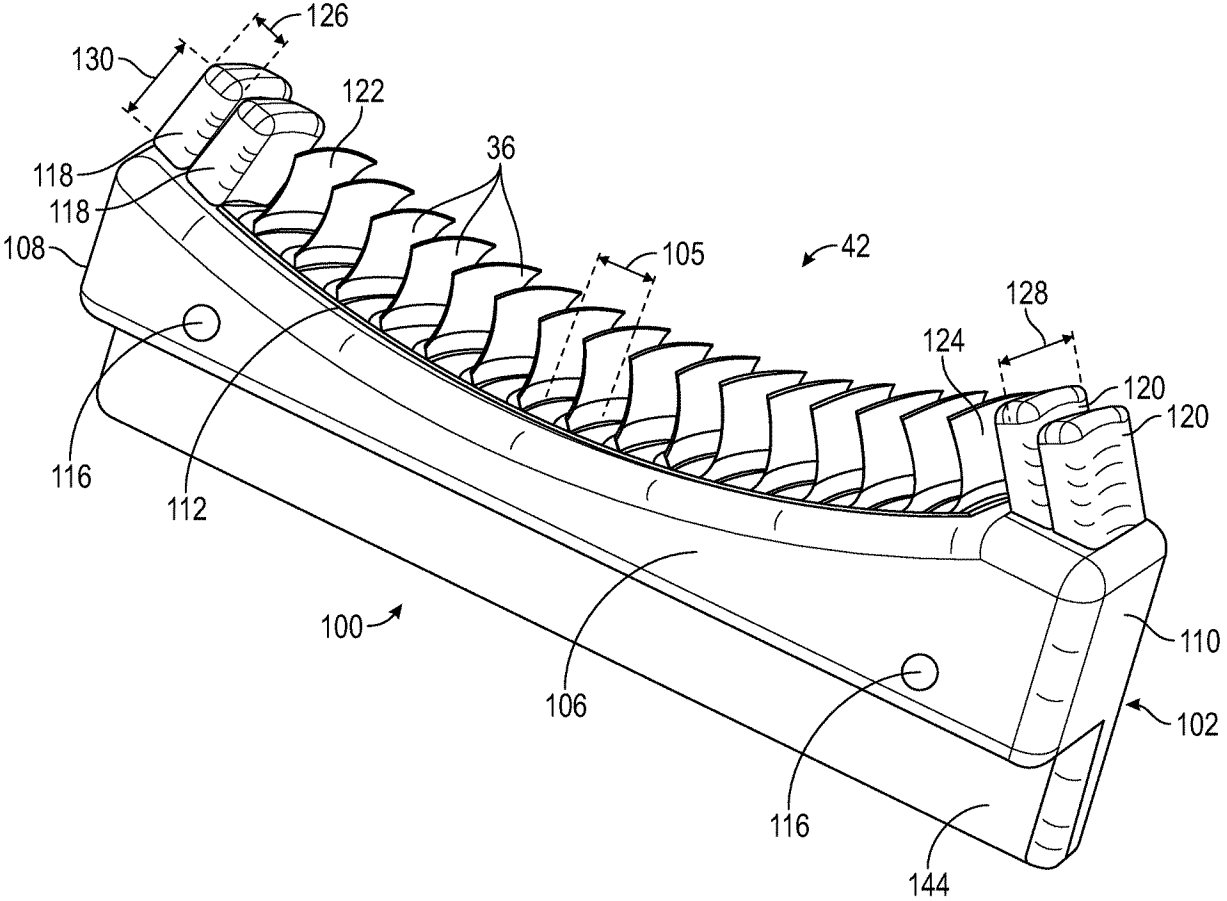
FIG. 3A is a perspective view of another exemplary fixture with mock airfoils, with the airfoil cluster of FIG. 2 mounted therein.

Referring now to FIGS. 3 and 4, one exemplary embodiment of a system 100 for media finishing the cluster 42 to have the desired surface 46 is provided. As shown, the media finishing system 100 may generally include a fixture 102 that is attachable to a media finishing mechanism 103. The media finishing mechanism 103 may include a drive arm 104, with the cluster 42 being positioned thereon. Typically, the cluster 42 includes a plurality of airfoils 36, such as stator vanes or rotor blades, separated by a distance 105. Moreover, the cluster 42 and each airfoil 36 may have a radial curvature that are sized and configured according to the size and configuration of the associated engine 20 into which they will ultimately be placed.

The fixture 102 of FIG. 3 may include a base 106 extending between a first end 108 and a second end 110, and a receptacle 112 disposed on a surface of the base 106 configured to at least partially receive the cluster 42 therein. The receptacle 112 may be rounded or provided with a radial curvature corresponding to the curvature of the cluster 42. More specifically, the receptacle 112 may be configured to sufficiently hold and secure the cluster 42 therein during a drag finishing process, or the like, without obstructing the flow of media to the airfoils 36 as will be described in further detail herein. The base 106 may further include a handle 114, such as a keyed structure, or the like, that is receivable within or attachable to spindles or the drive arm 104 of the media finishing mechanism 103. In addition, the base 106 may include apertures 116 for receiving pins, screws, bolts, or any other suitable means for removably coupling the base 106 to a media finishing mechanism.

Still referring to FIG. 3, the base 106 of the fixture 102 may additionally include at least one mock airfoil 118, 120 at each of the first and second ends 108, 110 thereof. More specifically, the first mock airfoil 118 may be positioned adjacent to the first endmost airfoil 122, and the second mock airfoil 120 may be positioned adjacent to the second endmost airfoil 124, where each mock airfoil 118, 120 is separated from its adjacent airfoil 122, 124 by a distance approximating the distance of separation 105 between airfoils 36 Each mock airfoil 118, 120 may also be aligned relative to the radial curvature of the airfoils 36 of the stator cluster 10, and radially inwardly extending from the base 106. In addition, each mock airfoil 118, 120 may be configured with a generally axial curvature which substantially parallels the axial curvature of each of the airfoils 36 of the stator cluster 42 to provide for a more consistent flow of abrasive media therethrough. Furthermore, each mock airfoil 118, 120 may be arranged and sized in a manner which reduces inconsistencies in the wear rate among the airfoils 36.

In particular, the mock airfoils 118, 120 may be provided with a general thickness 126, width 128 and/or height 130 configured to appropriately obstruct the flow of abrasive media against the endmost airfoils 122, 124 and to correct for any excess wear thereon. For example, if only one mock airfoil 118, 120 is provided at each end 108, 110 of the base 106 as in FIG. 3, the general thickness 126 of each mock airfoil 118, 120 may be greater than the thickness of each airfoil 36. Correspondingly, if more than one mock airfoil 118, 120 is provided at each end 108, 110 of the base 106, the general thickness 126 of each mock airfoil 118, 120 may be substantially similar to the thickness of each airfoil 36. Alternatively or additionally, any one or more of the width 128, height 130, the distance of separation, the axial curvature, and the number of the mock airfoils 118, 120 may be adjusted to provide a more consistent wear rate across the airfoils 36 of a particular cluster 42.

With the cluster 42 so mounted into the fixture 102, both can then be lowered into a bath 140 filled with abrasive media 142, as shown in FIG. 4. This may be accomplished through actuation of the drive arm 104 as by hydraulic cylinders (not shown) or other suitable actuators of the media finishing mechanism 103. Once lowered into the bath 140, either the bath 140 or the fixture 102, or both, can be rotated relative to one another so as to cause the particles of the abrasive media 142 to engage the airfoils 36 and thus produce the desired aerodynamically smooth surface 46. Of course, the motion between the media 142 and airfoils 36 need not be rotational, but rather horizontal, vertical, torsional, and the like movement are possible as well, as long as sufficient abrasive interaction occurs between the bath 140 and airfoils 36 to produce the surfaces 46.

Significantly, not only does such motion result in the desired aerodynamically smooth surfaces 46, but through the provision of the mock airfoils 118, 120, the sacrificial material of the mock airfoils 118, 120 absorbs the brunt of the interaction, allowing the actual airfoils 36 therebetween to be more uniformly engaged by the abrasive bath 140. This results in more uniformly produced airfoils 36 that are better able to withstand actual use and to do so with a more predictable, and long-lasting, life span.

Figure 5:
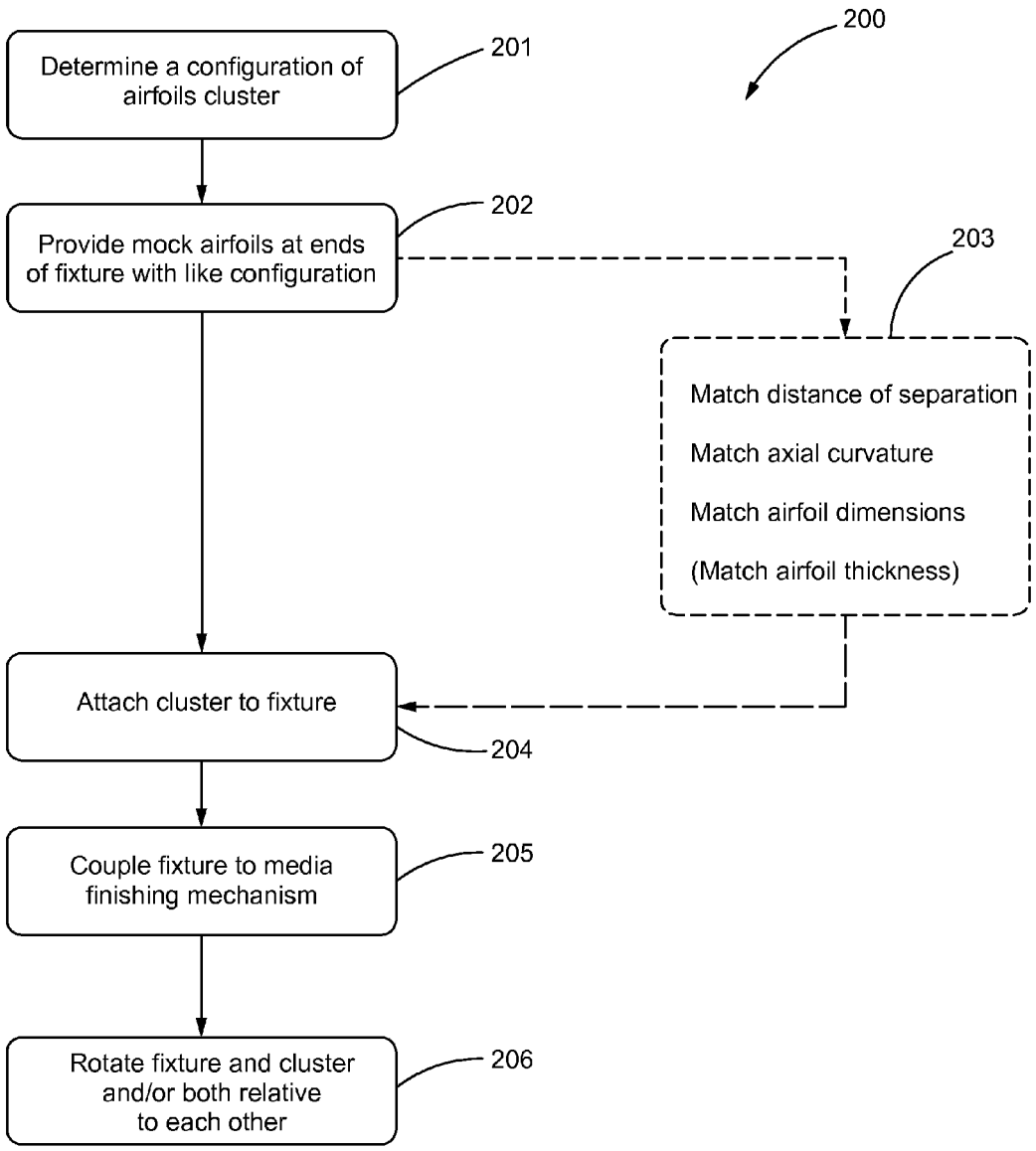
FIG. 5 is a flowchart of one exemplary method for media finishing a stator cluster according to the present disclosure.

Turning now to FIG. 5, one exemplary method 200 for media finishing a cluster 42, or preparations therefor, is provided. As shown, the method 200, in a step 202, may initially determine a configuration of the airfoils 36 of a given cluster 42. For example, the distance of separation 104 between airfoils 36, the axial curvature of each airfoil 36, the dimensions, such as the general thickness 126, of each airfoil 36, and the like, may be characterized. In a step 202, the fixture 102 may be provided with one or more mock airfoils 118, 120 disposed at each end 108, 110 thereof having like characteristics with the airfoils 36, as determined during step 202. As shown in an optional step 203 6, for example, the mock airfoils 118, 120 may be configured to substantially match the airfoils 36 in terms of the distance of separation 105, axial curvature, airfoil dimensions, and the like. The appropriate thickness 126 of the mock airfoils 118, 120 may vary according to the number of mock airfoils 118, 120 that are provided at each end 118, 120 of the fixture 102. Specifically, the appropriate thickness 126 of the mock airfoils 118, 120 may approximate the thickness of the airfoils 36 if a plurality of mock airfoils 118, 120 are provided at each end 108, 110 of the fixture 102. If only one mock airfoil 118, 120 is provided per end 108, 110, however, each mock airfoil 118, 120 may be made significantly thicker than each airfoil 36 of the given cluster 42.

Once the fixture 102 with appropriate mock airfoils 118, 120 is provided, the cluster 42 may be removably attached to the fixture 102 in a step 204. More specifically, as shown in FIG. 3, the cluster 42 may be securely seated within the receptacle 112 of the fixture 102 without obstructing the flow of media 142 through each of the airfoils 36 during a media finishing process, such as drag finishing. Additionally, in step 205, the base 106 of the fixture 102 may further be secured to the spindle or arm, or the like, of the media finishing mechanism 103. In a step 206, the fixture 102 and cluster 42 are then submerged in, and dragged through, the abrasive bath 140 to create the aerodynamically smooth surface 46. Upon completion of the media finishing process, the fixture 102 may be removed, and the stator cluster 42 may be removed from the fixture 102.

INDUSTRIAL APPLICABILITY

In general, the foregoing disclosure finds utility in various industrial applications relating to surface finishing of airfoils of gas turbine engines, such as blades and vanes of compressors and turbines of gas turbine engines. More specifically, the systems and methods disclosed may be used to provide improved and more consistent means of finishing, polishing and removing metals from the surfaces of airfoils disposed along a stator vane or rotor blade cluster of a compressor or turbine.

By providing a fixture for holding a cluster of airfoils which incorporates sacrificial mock airfoils positioned at each end of the fixture, the present disclosure corrects the flow of abrasive media applied to the endmost airfoils, such that the overall wear rate is more consistent throughout a given cluster regardless of the relative positions of the airfoils.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A fixture for coupling a cluster of airfoils to a media finishing mechanism, the fixture comprising:

a base having a first end and a second end;

a receptacle disposed on the base and configured to receive the cluster; and at least one mock airfoil disposed at each of the first and second ends of the base laterally outboard of the receptacle in alignment with the airfoils of the cluster, the at least one mock airfoil having an axial curvature parallel to that of the airfoils of the cluster of airfoils.

2. The fixture of claim 1, wherein the receptacle includes a radial curvature equal to a radial curvature of the cluster, and each of the mock airfoils includes an axial curvature equal to an axial curvature of each of the airfoils of the cluster.

3. The fixture of claim 1, wherein each mock airfoil is configured to reduce a wear rate of the endmost airfoils.

4. The fixture of claim 1, wherein the base includes more than one mock airfoil on each end thereof, each mock airfoil having a thickness which approximates a thickness of each airfoil.

5. The fixture of claim 1, wherein the base includes one mock airfoil on each end thereof, each mock airfoil having a thickness that is greater than a thickness of each airfoil.

6. The fixture of claim 1, wherein the base is attachable to a drag finishing mechanism.

7. A system for media finishing, comprising:

at least one airfoil cluster, a fixture having a first end, a second end, and a receptacle disposed between the first and second ends configured to receive the airfoil cluster;

at least one mock airfoil disposed at each of the first and second ends of the fixture laterally outboard of the receptacle in radial alignment with and adjacent to the endmost airfoils of the airfoil cluster, the at least one mock airfoil having an axial curvature parallel to that of the airfoils of the cluster of airfoils; and an abrasive media bath into which the fixture and the airfoil cluster are placed.

8. The system of claim 7, wherein the airfoils are radially inwardly disposed on the airfoil cluster and separated by a predefined distance, each mock airfoil being radially inwardly disposed on the fixture and separated from the adjacent endmost airfoil by the predefined distance.

9. The system of claim 7, wherein the receptacle includes a radial curvature equal to a radial curvature of the airfoil cluster, and each of the mock airfoils includes an axial curvature equal to an axial curvature of each of the airfoils of the airfoil cluster.

10. The system of claim 7, wherein each mock airfoil is sized and configured to reduce a wear rate of the endmost airfoils.

11. The system of claim 7, wherein a thickness of each mock airfoil is greater than a thickness of the airfoils.

12. The system of claim 7, wherein more than one mock airfoil is disposed at each end of the fixture.

13. The system of claim 12, wherein a thickness of each mock airfoil is substantially equal to a thickness of the airfoils.

14. The system of claim 7, wherein the airfoil cluster is one of a stator vane cluster and a rotor blade cluster.

15. A method for media finishing a cluster having a plurality of airfoils, comprising the steps of:

providing a fixture including:

a base having a first end and a second end;

a receptacle disposed on the base and configured to receive the cluster; and at least one mock airfoil disposed at each of the first and second ends of the base laterally outboard of the receptacle in alignment with the airfoils of the cluster, the at least one mock airfoil having an axial curvature parallel to that of the airfoils of the cluster of airfoils attaching the cluster onto the fixture such that each mock airfoil is positioned adjacent to and in alignment with an endmost airfoil of the cluster;

coupling the fixture to a media finishing mechanism.

16. The method of claim 15, further including sizing and configuring each mock airfoil to reduce a wear rate of the endmost airfoils.

17. The method of claim 15, further including providing the fixture with a receptacle for receiving the cluster thereon, the receptacle being provided with a radial curvature equal to a radial curvature of the cluster.

18. The method of claim 15, further including providing more than one mock airfoil on each end of the fixture, each mock airfoil having substantially the same thickness as each airfoil of the cluster.

19. The method of claim 15, further including configuring each mock airfoil such that an axial curvature thereof equals an axial curvature of the cluster airfoils.

20. The method of claim 15, further including dragging the fixture and cluster through an abrasive bath.

* * * * *